US005183216A

United States Patent [19]

Wack

[11] Patent Number: 5,183,216

[45] Date of Patent: Feb. 2, 1993

[54] DEMOLISHING APPARATUS

[76] Inventor: Helmut Wack, Am Langen Zaun 7, D-6653, Blieskastel, Fed. Rep. of Germany

[21] Appl. No.: 680,526

[22] Filed: Apr. 4, 1991

[30] Foreign Application Priority Data

Apr. 25, 1990 [DE] Fed. Rep. of Germany ..... 4013126

[51] Int. Cl.[5] ..... B02C 1/10

[52] U.S. Cl. ..... 241/101.7; 241/266

[58] Field of Search ..... 241/101.7, 264, 266

[56] References Cited

U.S. PATENT DOCUMENTS

| | | | |
|---|---|---|---|
| 247,712 | 9/1881 | Tunstill | 241/264 X |
| 4,406,412 | 9/1983 | Alexandersson | 241/266 X |
| 4,776,524 | 10/1988 | Sakato | 241/101.7 |
| 4,838,493 | 6/1989 | LaBounty | 241/101.7 |
| 4,890,798 | 1/1990 | Tagawa et al. | 241/101.7 X |
| 4,934,616 | 6/1990 | Zepf | 241/101.7 X |
| 4,951,886 | 8/1990 | Berto | 241/101.7 |
| 5,004,168 | 4/1991 | Purser | 241/101.7 |

FOREIGN PATENT DOCUMENTS

| | | |
|---|---|---|
| 2722258 | 11/1978 | Fed. Rep. of Germany . |
| 2851320 | 1/1980 | Fed. Rep. of Germany . |
| 3623061 | 5/1987 | Fed. Rep. of Germany . |
| WO88/03213 | 5/1988 | PCT Int'l Appl. . |

OTHER PUBLICATIONS

NPK "Full Indexing Rotation Crushers S-22R/S-25R" Nippon Pneumatic Mfg. Co. Ltd.

*Primary Examiner*—Mark Rosenbaum
*Assistant Examiner*—Frances Chin
*Attorney, Agent, or Firm*—Antonelli, Terry, Stout & Kraus

[57] ABSTRACT

A demolition apparatus for breaking up and demolishing in particular reinforced concrete comprises two shear-like cooperating, hydraulically driven jaws, whereof one has at least two and the other at least three working ledges provided with breaking teeth and which are all juxtaposed in parallel and interengage in alternating manner in the closed position. For the effective crushing of conrete, in the case of the jaw with the larger number of working ledges, the two outer ledges are in a common plane at right angles to the closing movement, while the intermediate ledges are set back with respect to the closing movement. The reinforcement of reinforced concrete can be easily cut up in the same working stroke, in that in the working position facing sides of at least two juxtaposed working ledges of the two jaws cutting tools are provided between the breaking teeth and are set back with respect to the latter in the direction of the closing movement and move passed one another in shearing manner at the end of the closing movement.

21 Claims, 4 Drawing Sheets

DEMOLISHING APPARATUS

FIELD OF THE INVENTION

The invention relates to a demolishing apparatus for demolishing and breaking up, in particular, reinforced concrete, comprising two shearlike cooperating, hydraulically driven jaws, whereof one has at least two and the other at least three working ledges covered with breaking or demolishing teeth, which are all parallel juxtaposed and engage in one another in alternating manner in the closed position.

SUMMARY OF THE INVENTION

Demolishing apparatuses having the aforementioned construction are used directly on site for demolishing buildings of all types, technical installations, etc. In the case of the demolition of reinforced concrete buildings or the breaking up of reinforced concrete parts, special demands are made on such demolition apparatuses, because reinforced concrete is a very heterogeneous material made from extremely hard aggregates, cement and steel reinforcement. Whereas the steel reinforcement can be comparatively easily cut up by shears, the concrete must mainly be size-reduced by compressive forces. The compressive forces must be applied at a level over the compression strength of the concrete. This breaking up of the concrete must also take place first before the steel reinforcement is exposed and can be cut up.

In practice two apparatus types are known, whereof one called a concrete biter is only suitable for the breaking up of concrete, whereas the other is used for cutting up steel reinforcements. Concrete biters, which must mainly apply high compressive forces to the concrete surface, have breaking teeth running either along or across the jaws (DE-A-33 42 305, WO 88/03213). The breaking teeth on the two jaws operate in opposition to one another, i.e. they rest on one another when the jaws are closed. Thus, the compressive forces are applied to the concrete surface directly between the facing breaking teeth and the concrete is largely destroyed by surface pressure. Thus, attempts are made to expose the steel reinforcement to the greatest possible extent. The steel reinforcement is cut up by similarly constructed apparatuses, but whose jaws are equipped with cutting tools (DE-A-27 22 258, 36 23 061). The jaws or the cutting tools fitted thereto are so reciprocally arranged that they move passed one another in shearing manner on closing the jaws and separate the reinforcement by a cutting movement.

In addition, combined apparatuses are known, which can both break up concrete and cut through the reinforcement (DE-A-28 51 320, the brochure NPK "CRUSHERS" 85.11 10U of Nippon Pneumatic Mfg. Co. Ltd.). In the case of such apparatuses both jaws carry both breaking teeth and cutting tools, the breaking teeth being exclusively located in the area of the jaws remote from the shear joint, whereas the cutting tools are located in the area of the jaws close to the shear joint. Although these combined demolition apparatuses have the advantage that only a single apparatus is required for all the demolition work, they suffer from the disadvantage that both operations must take place successively, i.e. the concrete must firstly be size-reduced to such an extent that the reinforcement is exposed. The demolition apparatus with the jaws open is then adjusted in such a way that the reinforcement is brought between the cutting tools. This requires very precise working, which is scarcely possible in the given circumstances. Particularly in the case of the comminution and breaking up of concrete, it is not possible to avoid concrete parts passing between the cutting tools, which therefore rapidly become blunt or break off. In addition, due to the local subdivision between the breaking teeth and the cutting tools, there is either a long operation of the jaws or the available breaking and cutting faces are necessarily arranged over a smaller working length and are consequently less effective compared with the previously mentioned apparatus types.

All the aforementioned demolition apparatuses suffer from the disadvantage that the effective surface made available by the breaking teeth is relatively small, so that most of the time is required for the breaking up and crushing of the concrete, whilst the separation or cutting up of the steel reinforcement can easily take place in a short time. In apparatuses used exclusively for breaking up concrete, account is taken of this in known construction in that on the one jaw are provided three parallel working ledges with breaking teeth, whereas on the other jaw there are two staggered working ledges with breaking teeth. The two ledges on one jaw, in the closed position, engage between the three ledges on the other. This significantly increases the effective surface of the breaking teeth and consequently bending forces act in addition to the compressive forces. Due to the fact that the breaking teeth of all the working ledges act simultaneously, a correspondingly high drive capacity must be installed. This construction is unfavorable for reinforced concrete, because the reinforcement cannot be separated or cut up and can be drawn between the working ledges on closing the jaws and can then not be removed again. Another disadvantage is that said apparatus cannot be directly used for demolition. For installation on an excavator one of the jaws is rigidly coupled to the shovel arm, whereas the other jaw is connected to the shovel tilting cylinder, which supplies the driving power for the demolition apparatus. This rigid attachment requires a very careful movement of the excavator up to the demolition point, so as not to introduce excessive twisting or torsional forces into the shovel arm, but this is only rarely possible in practice.

Summary of The Invention

On the basis of the first-mentioned and last-described demolition apparatus, the aim underlying the invention essentially resides in providing a construction enabling the concrete to be broken up in an effective, energy-saving manner. It must also be possible to break up and crush random quality reinforced concrete and it must finally also be possible to use the demolition apparatus on site without endangering the excavator shovel arm.

In the case of the aforementioned demolition apparatus, according to the invention, the jaw with the larger number of working ledges includes two outer ledges disposed in a common plane at right angles to the closing movement, while the interposed working ledges are set back with respect to the closing movement.

As a result of this construction, the breaking teeth are located in different planes at right angles to the closing movement of the jaws and, consequently, come into action at different times. Firstly the two outer working ledges on the jaw with the larger number of working ledges act together with the working ledges on the other jaw. Between the two outer working ledges considerable bending forces build up on the component to be broken up or crushed and these forces lead to breaking. If the working ledges on the jaw with the smaller number travel passed the outer working ledges of the other jaw, the inner working ledges and, consequently, mainly compressive forces come into action. Thus, it is simultaneously a multistage breaking process involving combined bending and compressive forces.

According to a preferred construction one jaw has three and the other jaw four working ledges, whereof the two central ledges are set back, whereas, in the other jaw, the central working ledge is moved forwards compared with the outer ledges.

Thus, in this construction, the breaking teeth on the two outer working ledges of one jaw and the breaking teeth of the central working ledge on the other come into action. On further closing, mainly the central part of the demolition material located between the jaws is stressed, namely, between the central ledge of one jaw and the two inner ledges of the other jaw. Simultaneously, the outer parts of the area located between the jaws are stressed between the outer working ledges of both jaws. As a result of the construction according to the invention it is possible to rapidly and effectively break up concrete.

A conventional scrap shearing machine can then be used for separating and cutting up the reinforcement. However, a further preferred embodiment of the invention is characterized in that cutting tools are arranged between the breaking teeth on the sides facing one another in the closed position of at least two juxtaposed working ledges of the two jaws and are set back towards the closing movement compared with the breaking teeth and move in shearing manner passed one another towards the end of the closing movement.

This inventive construction makes it possible in the same power stroke to both destroy the concrete and cut up the steel reinforcement and this applies over the entire working length of the jaws. As a result of the arrangement of the cutting tools on the facing sides of the working ledges, they are largely protected against direct action on the concrete, particularly as concrete parts cannot penetrate the shearing gap as a result of the fact that the cutting tools move in shearing manner passed one another. This construction allows an effective and rapid breaking up of reinforced concrete buildings, as well as the crushing of reinforced concrete components.

Preferably, the cutting tools are located on the central working ledge of the three ledges of one jaw and on one of the two central working ledges of the other jaw, so that the cutting tools only come into action when all the breaking teeth are active. Thus, the cutting tools are best protected against the concrete.

It is normally sufficient to cut up the steel reinforcement at a single point in the working area of the jaws. It is optionally also possible to provide cutting tools on the facing sides of all the working ledges.

A further preferred embodiment is characterized in that the breaking teeth on the working ledges of at least one jaw are pointed and a rounded depression is positioned between the surfaces of adjacent breaking teeth of said working ledges and that the effective shearing edge of the cutting tools approximately touches the lowest point in the depression.

As a result of the pointed construction of the breaking teeth and the rounded depressions located between adjacent breaking teeth, the important advantage is obtained that, after the breaking teeth have come into action, the steel reinforcement moves along the tooth surfaces into the rounded depressions and is necessarily engaged there by the cutting tools. It is in particular not possible for the steel reinforcement to jam between the breaking teeth, so as to merely bend or even block the jaws.

This is further assisted by the fact that at right angles to the movement direction of the jaws, the breaking teeth have roughly linearly directed breaking edges with tooth surfaces falling away to either side.

The breaking teeth necessarily move the steel reinforcement outwards into the depressions on one jaw, so that there are controlled cutting conditions as in the case of a special shearing machine.

Advantageously, the breaking teeth are replaceably arranged on the working ledges. For example, the breaking teeth with a back surface facing the working ledge can engage on a flat abutment on the ledge and have at least one guide part engaging in a depression on the abutment of the ledge and by which they are fixed to the ledge.

Thus, the breaking teeth are perfectly positioned and the forces are introduced flat into the jaws from the breaking tooth. Unlike in the case of the conventional deposit-welding of the breaking teeth to the jaws of the demolition apparatus, in the case of the inventive construction the breaking teeth can easily be replaced when worn.

According to another advantageous development of the present invention the cutting tools are also replaceably located on the working ledges, so that they can be replaced when worn. Preferably, the construction is such that the cutting tools are constructed as square cutting tips, which are fixed in their center to the working ledges and all of whose edges form cutting edges.

In this embodiment the cutting tools are constructed in the manner of throw-away cutting tool tips. All the longitudinal edges on both sides of the cutting tips act as shearing edges, so that each side has four shearing edges and the cutting tip has a total of eight shearing edges. The shearing edges on one side successively come into action by simply turning the cutting tip, while, after reversing the cutting tip, the shearing edges on the other side can be used.

Preferably, the cutting tips are embedded in the working ledges, so that they can be positioned in a completely satisfactory manner and can better absorb the forces.

According to an advantageous construction of the invention the breaking teeth are so arranged that the common plane of the breaking edges of the teeth of facing working ledges does not intersect the shear joint axis.

Thus, a larger maximum opening is obtained for a specific working stroke of the hydraulic drive cylinder for the jaws. It is also ensured that all material between the jaws and also in the outside area is broken up or cut up. This ensures an identical arrangement with respect to the shearing edges of the cutting tools.

Preferably, the common plane of the breaking edges of the breaking teeth and the shearing edges of the cutting tools on opposite working ledges are displaced in the same direction with respect to the shear joint axis.

A constructionally and force-favorable construction is characterized in that the working ledges are provided on the inner end and while interposing spacers, are braced on a king pin of the shear joint of the jaw and at the other end rigidly interconnected by a connecting ledge.

According to another embodiment of the invention the stability is further improved in that the working ledges are approximately triangular, with the shear joint being positioned in the vicinity of one angle, the connecting ledge in the vicinity of a second angle and a further connecting piece in the vicinity of a third angle.

As stated hereinbefore, the demolition apparatus jaws are driven hydraulically. According to an advantageous embodiment of the invention, a hydraulic cylinder in the vicinity of the third angle of one jaw, which is supported on an extension carrying the other jaw and extending beyond the shear joint. Appropriately the extension of one jaw is constructed as a casing and is set up for connection to an excavator shovel arm.

This construction makes it possible to so position the hydraulic cylinder in the casing, that the piston rod is always located within the same and that the hydraulic supply takes place via the piston rod.

This construction has the advantage that the most sensitive functional part of the demolition apparatus, namely, the piston rod is always located in protected manner in the casing and cannot be damaged by external forces, dropping parts or the like. Due to the fact that the jaws are not driven from the shovel tilting cylinder, the demolition apparatus can assume any random position with respect to the shovel arm, so that the demolition apparatus can attack any random point on the building without a precise moving up of the excavator.

This function is also fulfilled by another construction according to which a rotary connection and a rotary motor, whose rotation axis is approximately at right angles to the shear joint axis, are positioned between the casing and the shovel arm of the excavator.

Thus, the demolition apparatus can be rotated into any random position with respect to the excavator shovel arm, in order to permit effective action on the building or component.

Brief Description of The Drawings

The invention is described in greater detail hereinafter relative to a non-limitative embodiment and the attached drawings, wherein.

DETAILED DESCRIPTION

Figure 1:
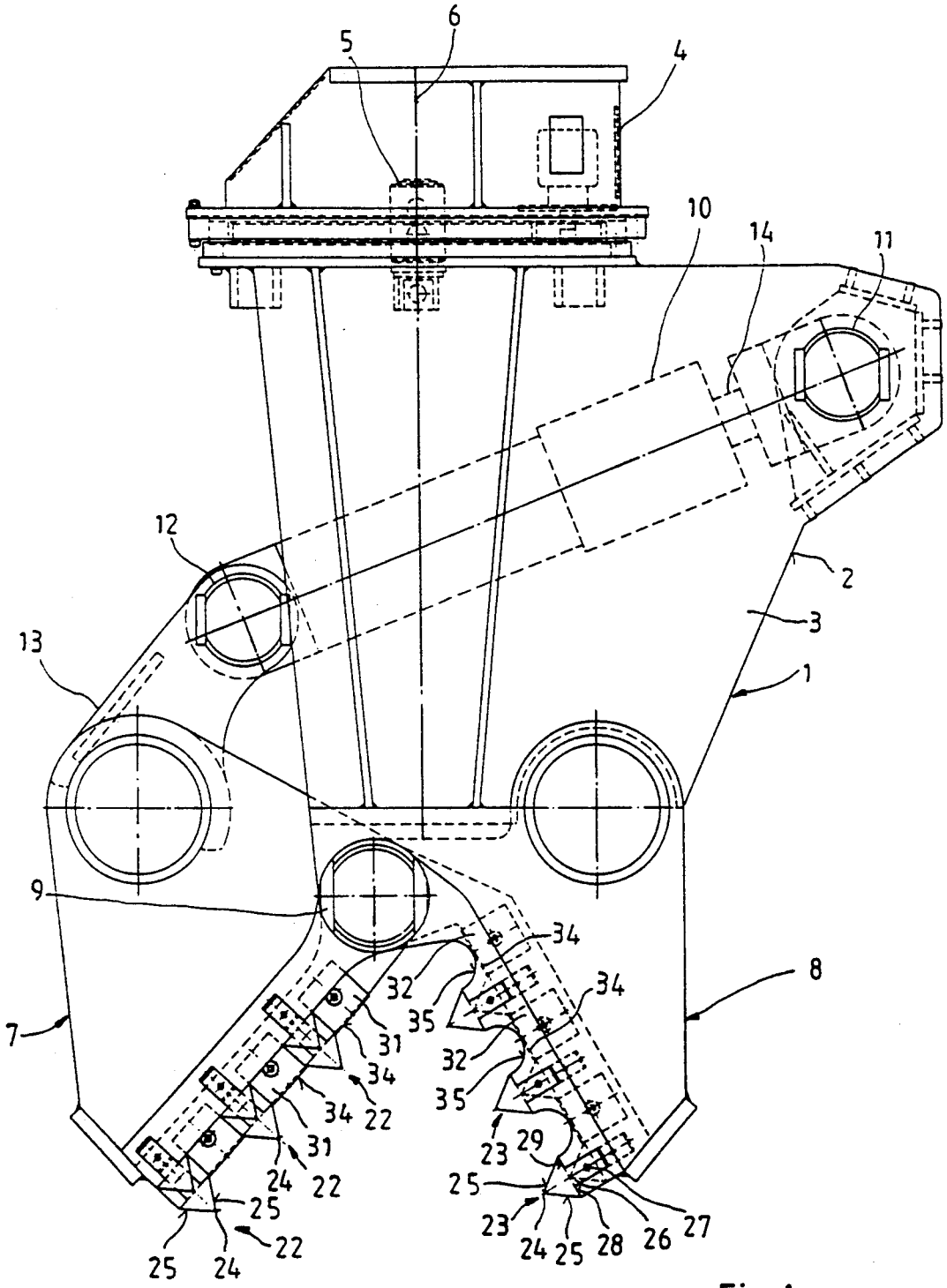
FIG. 1 is a side view of the demolition apparatus with the jaws open.
Figure 2:
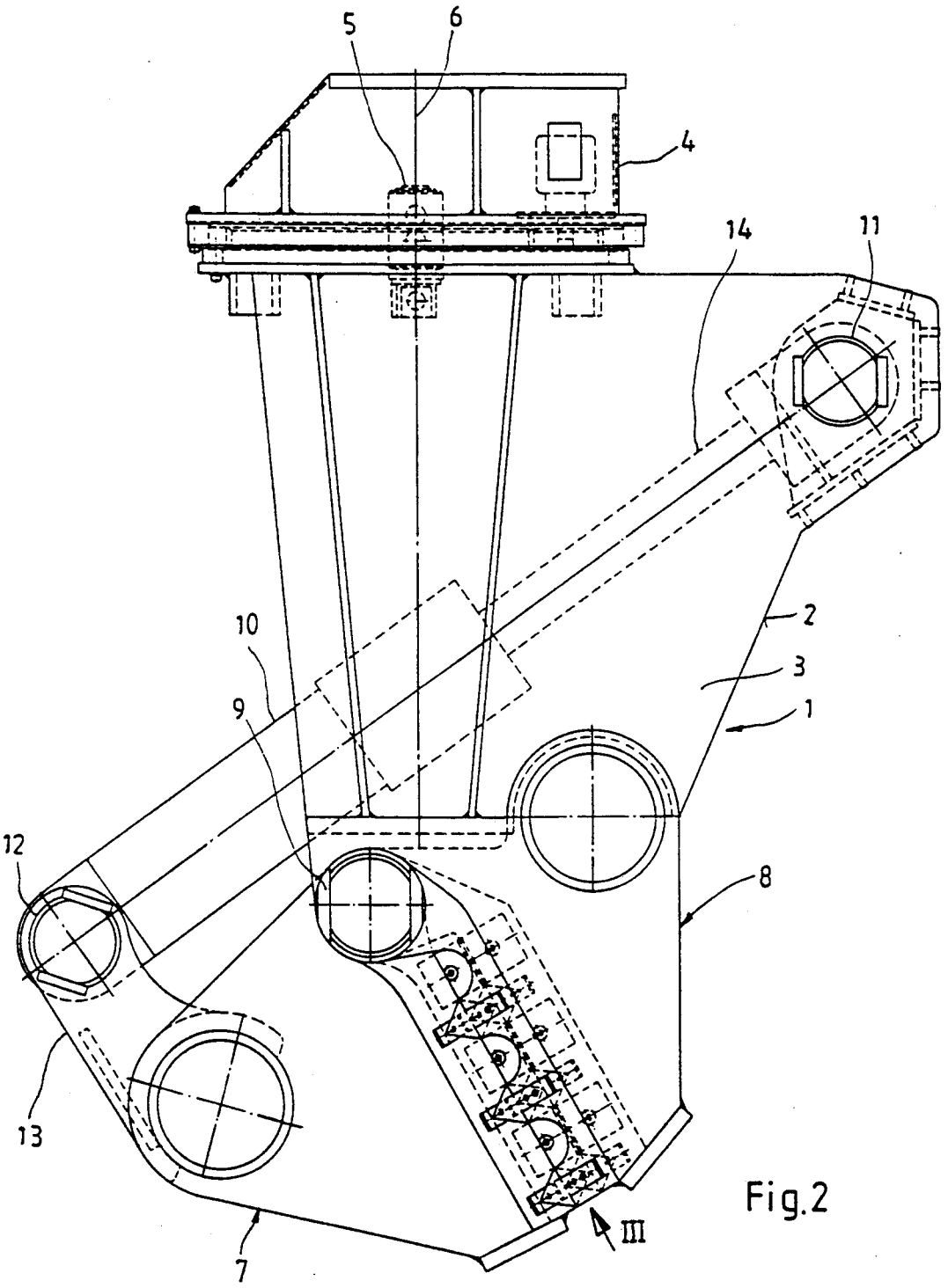
FIG. 2 is a side view corresponding to FIG. 1 with the jaws closed.

The demolition apparatus according to FIGS. 1 and 2 has a casing 1, which is formed from two side members 3 and a wall connecting the same at the side 2, while the side facing the side 2 is open. A connecting part 4 is positioned via a rotary connection on the upper part of the casing 1 and in it is located a rotary motor 5 for rotating the demolition apparatus about the axis 6.

The demolition apparatus has two jaws 7,8, which are substantially triangular. The jaw 8 is rigidly connected to the casing 1, while the other jaw 7 is articulated to the swivel bearing or shear joint 9. The drive for the jaw 7 includes a hydraulic cylinder 10, which is mounted at 11 in the casing 1 and acts via a joint 12 on an arm 13, which is, in turn, connected to the jaw 7. By the hydraulic cylinder 10 the jaw 7 can be pivoted out of the open position shown in FIG. 1 into the closed position shown in FIG. 2. During this movement the piston rod 4 of the hydraulic cylinder 10 is always located within the casing, in which the hydraulic cylinder 10 acts on the joint 12. The hydraulic supply takes place in the vicinity of the bearing 11 via corresponding ducts in the piston rod 14.

Figure 3:
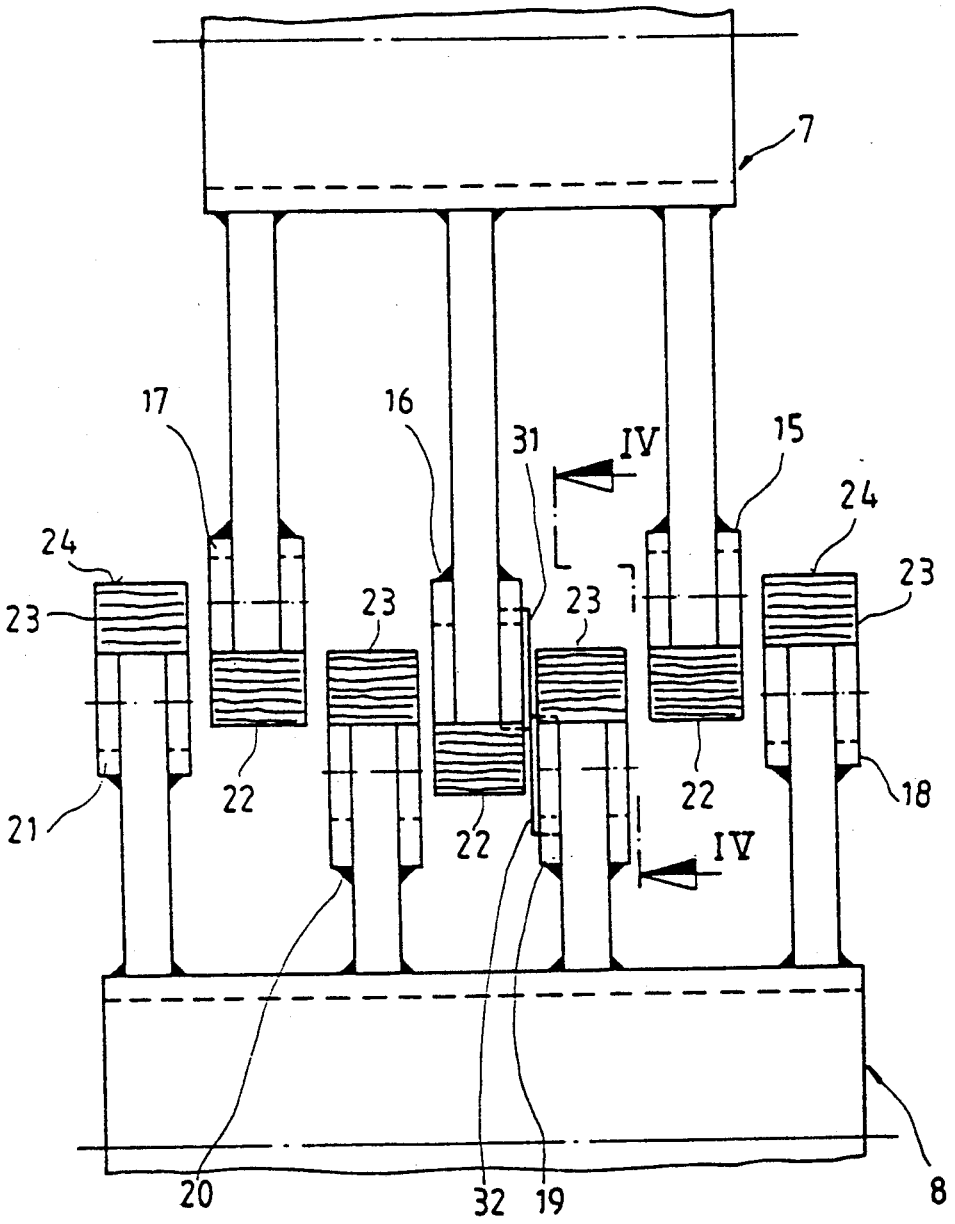
FIG. 3 is a view in taken in the direction of arrow 3 in FIG. 2.

As can be gathered from FIG. 3, the pivotable jaw 7 has three parallel, juxtaposed working ledges 15,16,17 and the fixed jaw 8 four parallel, juxtaposed working ledges 18,19,20,21. All the working ledges are equipped with several breaking teeth 22 or 23 successively arranged in the extension direction of the jaws. The breaking teeth 22 of the jaw 7 and the breaking teeth 23 of the jaw 8 are in each case located on common radii with respect to the swivel bearing 9, so that they act in direct opposition to one another during the closing movement. In the illustrated embodiment the breaking teeth are triangular and have a cutting edge 24 at right angles to the movement plane of the jaw 7 and from which the surfaces 34 fall away towards the jaw. The triangular breaking teeth 22,23 are replaceably placed on the jaws. For this purpose the teeth 22,23 have a guide part 26 with which they engage in a depression in the jaw and are fixed by a bolt 27 at right angles thereto. In this position the triangular teeth 22,23 are supported with the flat back 28 on a corresponding flat abutment 29 on the jaw.

As can be gathered from FIG. 3, the breaking teeth 22 are positioned on the jaw 7 and the breaking teeth 23 on the jaw 8 with their cutting edges not in the same plane. The breaking teeth 23 on the two outer working ledges 18,21 of the jaw 8 are located in one plane, while the breaking teeth 23 on the two intermediate working ledges 19,20 are set back with respect thereto. Conversely, the breaking teeth 22 on the central working ledge 19 of the jaw 7 are set forward compared with the breaking teeth 22 of the two outer working ledges 15,17 of the jaw. During the closing movement initially the breaking teeth 22 on the central working ledge 16 of the jaw 7 and the breaking teeth 23 on the two outer working ledges 18,21 of the jaw 8 come into action. Thus, the component fixed between the jaws is subject to compressive and bending stresses. During the further closing the central area of the fixed component is stressed between the central working ledge 16 of the jaw 7 and the two central working ledges 19,20 of the jaw 8, while in the outer area the breaking teeth on the outer working ledges 15,17 or 18,21 of both jaws come into action.

The working ledges 15,16,17 of one jaw 7 and the working ledges 18 to 21 on jaw 8 are braced against one another on the swivel bearing 9 by spacers, while they are rigidly interconnected at the outer end via connecting ledges 49. As stated, the working ledges are also triangular and in the vicinity of the third angle at 30 are braced against one another by a bolt passing through a screen and spacers.

The central working ledge 16 on the jaw 7 and one of the working ledges on the jaw 8 (ledge 18 in the represented embodiment) are equipped with cutting tools 31,32, which are constructed as square cutting tips. The cutting tips 31,32 are embedded in corresponding recesses on the working ledges 16,19 and fixed by a detachable fixing means 33. Each edge 34 of each cutting tool 31,32 forms a shearing edge, so that on turning the cutting plates 31,32 and by reversal a total of eight shearing edges are made available.

As stated, the cutting tools 31,32 are located on the central working ledges 16,19 and, consequently, come into action last on closing the jaws 7,8. They are located on the facing sides of the two working ledges below the breaking teeth 22,23.

In the illustrated embodiment the shearing edges 34 of the cutting tools 31 on the working ledge 16 of the jaw 7 form the tooth root between the breaking teeth 22, so that said root is linear. However, on the facing jaw 8 rounded depressions 35 are connected to the surfaces 25 of the breaking teeth 23. The cutting tools 32 on the working ledge 19 of the jaw 8 make contact by their shearing edge 34 with the depression 35 at the deepest point. On closing the jaws 7,8, the concrete located between the jaws is broken and crushed. The reinforcement which cannot be crushed by the breaking teeth 22,23 is moved towards the end of the closing movements by the surfaces 25 of the breaking teeth 22,23 into the depressions 35, where it is effectively engaged and cut up by the shearing edges 34 of the cutting tools 31,32.

Figure 4:
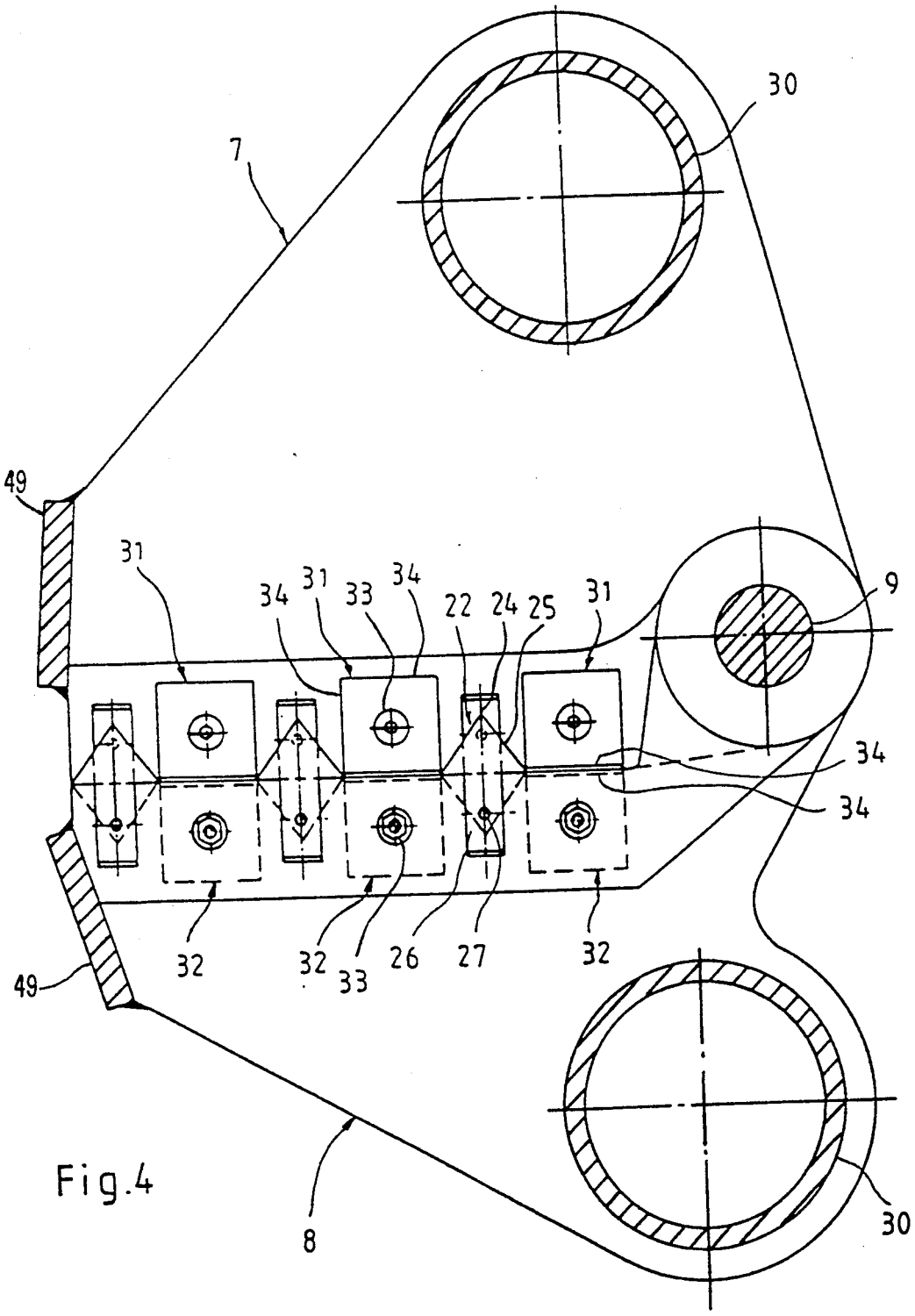
FIG. 4 is a section taken along line IV—IV in FIG. 3.

As can in particular be gathered from FIGS. 2 and 4, the common plane of the effective shearing edges 34 of the cutting tools 31,32 is positioned eccentrically with respect to the swivel bearing 9. In the same way the common planes of the breaking teeth 22,23 of the different working ledges are in a position eccentrically displaced to the same side with respect to the swivel bearing 9.

I claim:

1. Demolition apparatus for the demolition and breaking up of concrete, the apparatus comprising:

two shear-like cooperating hydraulically driven jaws, one of said jaws including at least two working ledges and the other of said jaws includes at least three working ledges, said working ledges are all parallel juxtaposed and engage in one another in an alternating manner in a closed position of the jaws; and breaking teeth provided on the respective working ledges, wherein the jaw provided with the at least three working ledges includes two outer working ledges with the third working ledge being disposed substantially centrally of the outer working ledges, the two outer working ledges are in a common plane substantially at a right angle to a closing movement of the jaws, with the third working ledge being set back with respect to the closing movement of the jaws, and wherein cutting tools are arranged on opposed facing sides of at least two juxtaposed working ledges of the jaws between the breaking teeth, said cutting tools being set back in the direction of the closing movement of the jaws relative to the breaking teeth and being adapted to pass one another in a shearing manner towards the end of the closing movement of the jaws.

2. Demolition apparatus according to claim 1, wherein the cutting tools are arranged on the facing sides of all the working ledges.

3. Demolition apparatus according to claim 1, wherein the breaking teeth on the working ledges of at least one jaw are pointed, and a rounded depression is located between surfaces of adjacent breaking teeth of said working ledges, and wherein an effective shearing edge of the cutting tools substantially contacts a lowest point of the depression between said breaking teeth.

4. Demolition apparatus according to claim 1, wherein the breaking teeth have approximately linearly directed breaking edges with tooth surfaces falling away to other sides substantially at right angles to the movement direction of the jaws.

5. Demolition apparatus according to claim 1, wherein the breaking teeth are replaceably mounted on the working ledges.

6. Demolition apparatus according to claim 1, wherein the cutting tools are replaceably arranged on the respective working ledges.

7. Demolition apparatus according to claim 1, wherein one jaw has three working ledges and the other has four working ledges, two central ledges of the jaw with four working ledges are set back with respect to two outer ledges, and wherein the central working ledge of the jaw with three working ledges is set forward with respect to the two outer working ledges of the jaw with the three working ledges.

8. Demolition apparatus according to claim 7, wherein the cutting tools are located on the central ledge of the jaw with three working ledges and on one working ledge of the two central working ledges of the jaw with four working ledges.

9. Demolition apparatus according to claim 1, wherein each of the breaking teeth has a back surface facing the respective working ledges and at least one guide part, said back surface is engageable on a flat abutment of the associated working ledge, and wherein said at least one guide part is engageable in a depression on an abutment of the associated working ledge so as to enable a fixing of the respective breaking teeth to the respective working ledges.

10. Demolition apparatus according to claim 9, wherein the breaking teeth are fixed by bolts traversing the associated working ledge and the guide part.

11. Demolition apparatus according to claim 1, wherein the cutting tools include square cutting tips fixed a respective centers thereof to the working ledges and wherein all edges of the cutting tips form shearing edges.

12. Demolition apparatus according to claim 11, wherein the cutting tips are embedded in the working ledges.

13. Demolition apparatus according to claim 12, wherein a common plane of the shearing edges of the cutting tools of facing working ledges does not intersect an axis of a shear joint of the jaws.

14. Demolition apparatus according to claim 1, wherein the breaking teeth are arranged in such a manner that a common plane of breaking edges of the respective breaking teeth of facing working ledges does not intersect an axis of a swivel joint pivotally joining the jaws to each other.

15. Demolition apparatus according to claim 14, wherein a common plane of the breaking edges of the breaking teeth and shearing edges of the cutting tools are displaced in the same direction with respect to an axis of a shear joint on facing working ledges of the jaws.

16. Demolition apparatus according to claim 15, where all of the working ledges are supported on a king pin of the shear joint of the jaws disposed at an inner end of the jaws, and wherein a connecting ledge is provided at an outer end of the respective jaws for rigidly interconnecting the working ledges to the respective jaws.

17. Demolition apparatus according to claim 16, wherein the working ledges of the respective jaws are disposed along a leg of a triangle having the shear joint located in a vicinity of one angle of the triangle, the connecting ledge located in a vicinity of a second angle of the triangle, and a further connecting piece located in a vicinity of a third angle of the triangle.

18. Demolition apparatus according to claim 17, wherein a hydraulic cylinder acts in the vicinity of the third angle, said hydraulic cylinder supported on an extension projecting over and beyond the shear joint.

19. Demolition apparatus according to claim 1, wherein an extension of one jaw is constructed as a casing and is used for connecting the jaw to an excavator shovel arm.

20. Demolition apparatus according to claim 19, wherein the hydraulic cylinder is arranged in the casing such that a piston rod is located within the casing in all positions, and wherein hydraulic supply takes place through the piston rod.

21. Demolition apparatus according to claim 20, wherein a rotary connection and a rotary motor are provided between the casing and the excavator shovel arm, and wherein an axis of rotation of the rotary connection extends substantially at a right angle to an axis of a shear joint of the jaws.

* * * * *